US005128503A

United States Patent [19]

Frantz

[11] Patent Number: 5,128,503

[45] Date of Patent: Jul. 7, 1992

[54] ROTATIONAL CONTROL DIAL WITH FLUSH/PROTRUDING FLIP HANDLE

[75] Inventor: Mark G. Frantz, New York, N.Y.

[73] Assignee: Frantz Medical Development Ltd., New York, N.Y.

[21] Appl. No.: 80,643

[22] Filed: Jul. 31, 1987

[51] Int. Cl.[5] ..... H01H 3/08

[52] U.S. Cl. ..... 200/336; 74/553; 74/555; 200/43.01

[58] Field of Search ..... 200/336, 334, 43.01, 200/43.16, 330, 155 A, 156, 155 R, 564, 566; 74/555, 554, 553; 128/303.13, 303.14, 303.17, DIG. 12, DIG. 13; 604/49

[56] References Cited

U.S. PATENT DOCUMENTS

| | | | |
|---|---|---|---|
| 3,066,550 | 12/1962 | Sundberg | 74/553 |
| 3,384,729 | 5/1968 | Burris, Jr. et al. | 200/336 |
| 4,464,549 | 8/1984 | Fujita | 200/334 |
| 4,487,604 | 12/1984 | Iwatschenko et al. | 128/DIG. 12 |
| 4,601,707 | 7/1986 | Albisser et al. | 128/DIG. 12 |
| 4,684,367 | 8/1987 | Schaffer et al. | 128/DIG. 13 |

FOREIGN PATENT DOCUMENTS

| | | | |
|---|---|---|---|
| 2161367 | 5/1973 | Fed. Rep. of Germany | 74/553 |

*Primary Examiner*—Renee S. Luebke
*Attorney, Agent, or Firm*—Frishauf, Holtz, Goodman & Woodward

[57] ABSTRACT

A control dial features a disk-shaped handle with a diametrical pivot, permitting pivoting of the handle from a first orientation flush with the surface of the controlled device to a second position perpendicular to the surface of the controlled device. In the second position, rotation of the handle carries with it a generally hemispherical housing in which the hinge or pivot is mounted. The housing, in turn, is mounted for rotation about an axis perpendicular to the surface of the controlled device, and is connected to a rotary switch which may be mounted on a printed circuit board fixed inside the controlled device.

1 Claim, 3 Drawing Sheets

ROTATIONAL CONTROL DIAL WITH FLUSH/PROTRUDING FLIP HANDLE

Cross-Reference to related applications, the disclosures of which are incorporated by reference:

DISPOSABLE CASSETTE FOR FLUID DELIVERY PUMP SYSTEM, Mark G. Frantz, Ser. No. 062,905, filed Jun. 16, 1987;

PUMP SYSTEM FOR ENTERAL/PARENTERAL FLUID CONTROL & DELIVERY, Frantz et al., Ser. No. 075,627, filed Jul. 20, 1987;

COMPACT PUMP SYSTEM FOR FLUID DELIVERY, Mark G. Frantz, Design Ser. No. 063,275, filed Jun. 16, 1987;

COMPACT POWER & POLE CLAMP ASSEMBLY FOR COMPACT FLUID DELIVERY PUMP SYSTEM, Mark G. Frantz, Design Ser. No. 063,274, filed Jun. 16, 1987;

DISPOSABLE MEDICAL PUMP CASSETTE, Mark G. Frantz. Design Ser. No. 063,273, filed Jun. 16, 1987.

The present invention relates generally to control dials, and more particularly to a safe rotary control dial with a handle with two orientations, a first orientation in which the switch cannot be actuated and nothing protrudes from the surface of the controlled device, and a second orientation in which the handle protrudes and can be used to rotate the dial housing in which the handle is mounted. The invention is particularly useful in medical devices and in potentially hazardous or precision machinery, such as lathes or milling machines, farm machinery, and the like.

BACKGROUND

The present invention is an improvement derived from a review of current electronically controlled medical devices, such as parenteral and enteral feeding pumps, and consumer household appliances, such as microwave ovens. These devices typically have touch panel overlays which activate membrane switches. It was found that operators, even those familiar with the device, are sometimes confused with respect to the sequential operation of the device. For example, if one wants to enter a numerical value, in which sequence does one depress: the control mode button, the numerical keypad, and the save/store button? It may also be difficult to determine which operating mode is currently activated. A further problem with overlay control panels is their susceptibility to accidental activation, and manipulation by unauthorized persons.

Rotational dials, such as those found on washing machines, are much easier than overlay control panels to understand and provide positive positional information. However, they present physical limitations. Dials typically protrude from the surface of the device, thus allowing for accidental or unauthorized turning. This is a particular problem for ambulatory devices, such as feeding pumps. The dial also creates a bulkier device. This is even a problem with recessed dials, which in turn, necessitate a larger device housing to accomodate the dial indentation.

Accordingly, it is the objective of the present invention to provide a control device which is easy to understand, prevents accidental and/or unauthorized tampering, and yet avoids protruding dials or major cavities into the device housing.

Briefly, the preferred embodiment of the invention features a disk-shaped handle with a diametrical pivot, permitting pivoting of the handle from a first orientation flush with the surface of the controlled device to a second position perpendicular to the surface of the controlled device. In the second position, rotation of the handle carries with it a generally hemispherical housing in which the hinge or pivot is mounted. The housing, in turn, is mounted for rotation about an axis perpendicular to the surface of the controlled device, and is connected to a rotary switch which may be mounted on a printed circuit board fixed inside the controlled device.

This invention has a number of advantages. It provides rotational dial simplicity without a fixed protruding dial handle, or a large cavity into the device. The operator is forced into an operational sequence by the dial rotation, and the dial position always indicates the activated control mode. Dials are familiar and comfortable control mechanisms.

The addition of the pivoting handle provides a large grip surface without creating a similar sized indentation into the device housing, which would enlarge the overall size of the device. The elimination of the fixed, protruding dial handle provides a more compact device and one which is more suitable for discreet, comfortable ambulatory positioning, such as in a vest or pouch. Further, the handle is preferably a rounded disk, such that there are no sharp edges which might snag and injure the fragile skin of a child, or of an elderly or malnourished patient. The handle in the closed position also avoids fluid spills into the housing cavity. The rounded disk edge tends to slide over, rather than snag on, the patient's skin or clothing.

The use of the pivoting handle also avoids accidental activation of the device, as is possible with a touch panel or a protruding dial. Someone may inadvertantly bump against a stationary panel; also a touch panel may be depressed, or a dial turned, in the normal course of carrying a device in an ambulatory mode. The closed position of the present invention prevents these problems, and also, discourages unauthorized tampering. Accidental or unauthorized manipulation of the controls may be highly undesirable; for example, control changes on a medical feeding pump could result in one of the following conditions which may result in serious patient complications: 1) cessation of fluid delivery, 2) over-or-under delivery, and 3) loss of vital microprocessor-stored information concerning delivery statistics.

DRAWING

DETAILED DESCRIPTION

Figure 1:
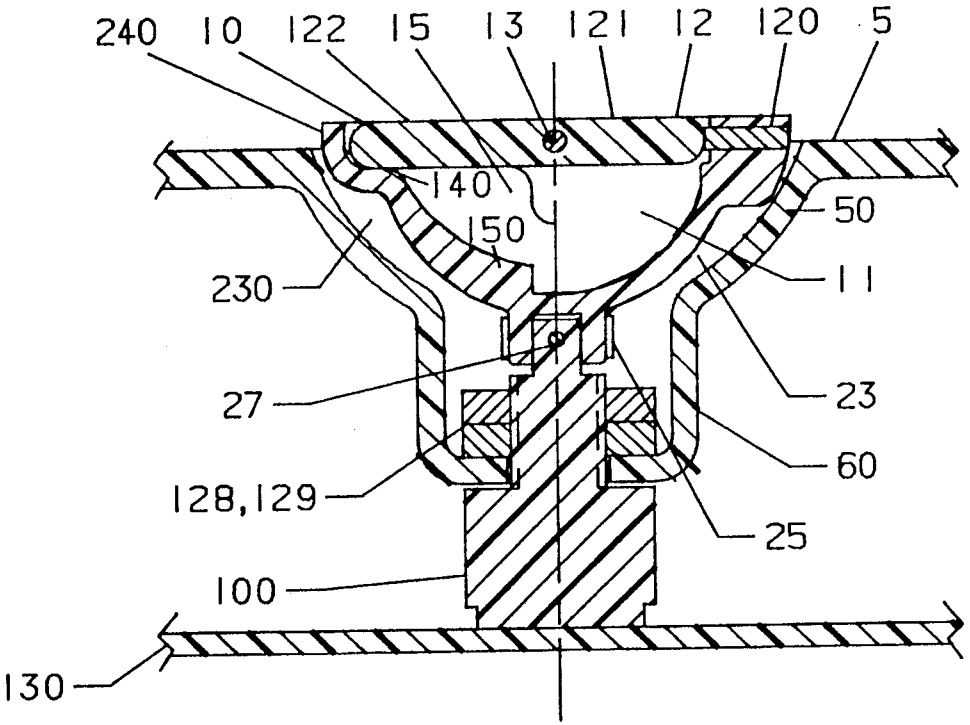
FIG. 1 is an enlarged cross-sectional view of the rotational control dial of the present invention, with the handle in the closed position, mounted in the case of a controlled device having a printed circuit (P.C.) board.

FIG. 1 illustrates the cross-sectional structure of the rotational control dial 10 of the present invention. The front case 5 of a device to be controlled by the control dial is formed with a generally hemispherical or bowl-shaped indentation 50 having a generally cylindrical well 60 at the bottom thereof, preferably extending perpendicular to the plane of the non-indented portion of front case 5. A handle door housing 23 is mounted within indentation 50. Housing 23 also has a generally bowl-shaped configuration, but has, over most of its surface, a smaller diameter than indentation 50, leaving some clearance 230 between the outer surface of indentation 50 and the outer surface of housing 23. However, housing 23 also has a generally circular protruding rim 240 which abuts the surface of indentation 50. Rim 240 helps to maintain centricity of housing 23 within indentation 50 when control dial 10 is rotated.

Control dial 10 includes a generally disk-shaped handle 12 which is mounted on a pivotable hingepin 13. This hingepin extends diametrically through disk 12 and into housing 23 on each side. The generally hemispherical inner surface of housing 23 has two portions of differing diameters. A first portion forms a quarter-spherical recess 11 into which an upper portion 121 of disk 12 may be pivoted. A second, reduced-diameter portion forms a thumb-receiving recess 15 and has an angular extent which is slightly less than quarter-spherical. The second portion terminates in an upper shoulder 140 which forms a stop against which disk portion 122 rests when disk 12 is flush with the non-indented part of front case 5 and terminates in a lower shoulder 150 which forms a stop against which disk portion 121 rests when disk 12 is pivoted perpendicular to the non-indented portion of front case 5.

Starting when disk 12 is flush, a person can push with a finger against disk portion 121, thereby pivoting it into recess 11, which becomes a finger-receiving recess. As disk portion 112 protrudes, a thumb can then be inserted into recess 15. By grasping handle disk 12 between finger and thumb, and rotating, one can then rotate entire housing 23 within indentation 50.

Indentation 50, well 60, and housing 23 have a common central axis A. A rotatable switch 100 is rotatably mounted on a printed circuit board 130 or the like, which preferably is fixed in a plane parallel to the non-indented portion of front case 5. Switch 100 is secured to housing 23 by a retaining pin 27 which extends diametrically through a central portion of housing 23 which preferably extends slightly into well 60. A retaining ring 25 around the the central portion of housing 23 also tends to compress it around a stem portion of switch 100. A nut 128 and washer 129 are mounted around the stem of switch 100 and abut the end surface of cylindrical well 60.

Figure 1A:
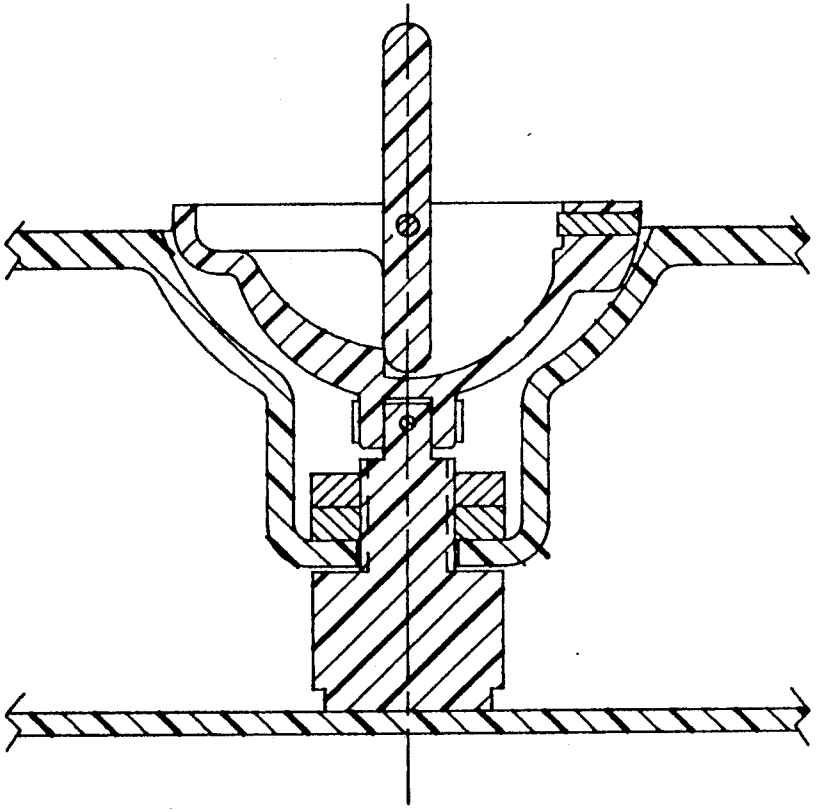
FIG. 1A is a cross-sectional view of the control dial, showing the handle in the open or protruding orientation.

FIG. 1A illustrates, somewhat enlarged, the control dial of FIG. 1, with disk 12 rotated into the protruding position, with one edge against stop 150.

Figure 2:
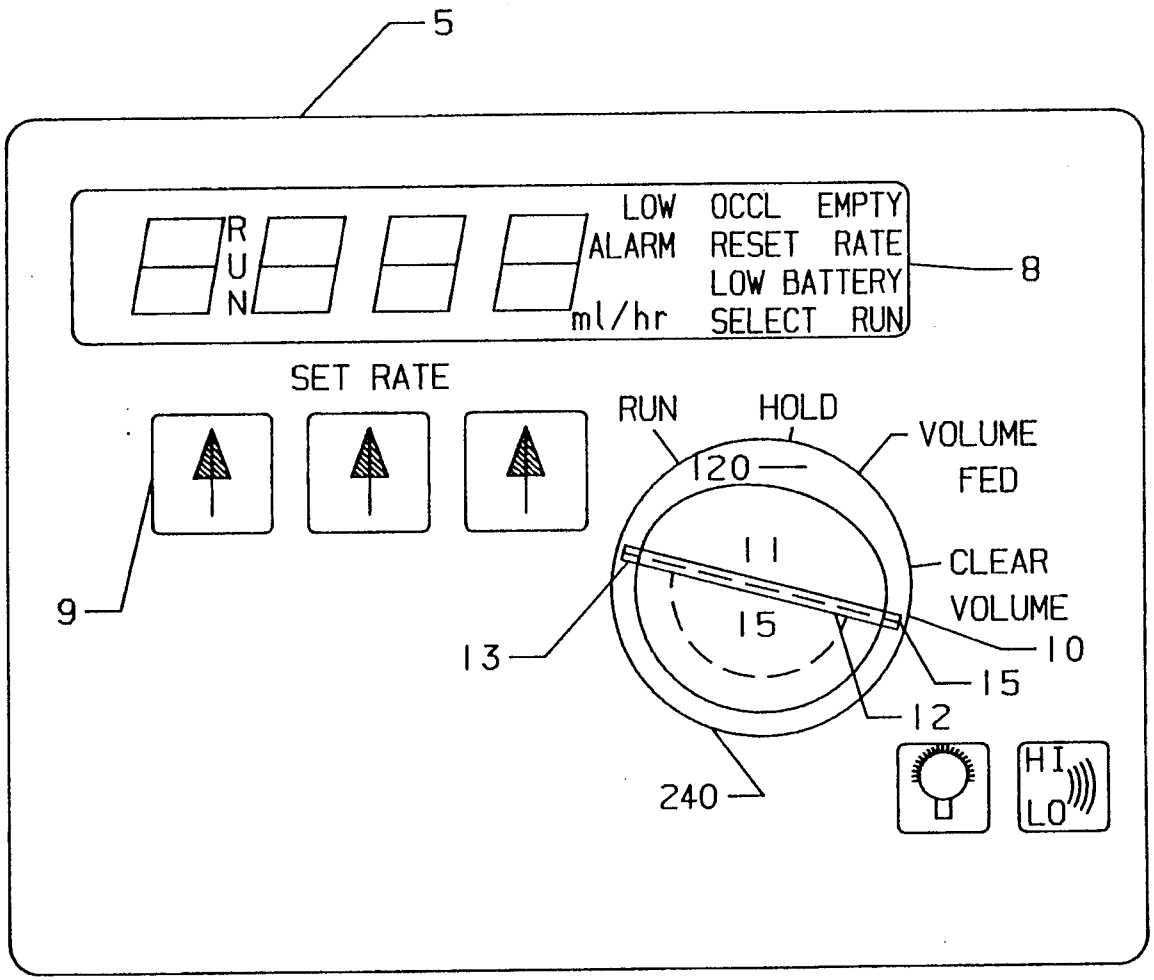
FIG. 2 is a front view, actual size, along axis A of FIG. 1, showing the control dial mounted on an example of a controlled device, with handle disk 12 in the protruding position, rotated perpendicular to the front case of the controlled device and perpendicular to the position shown in FIG. 1.

FIG. 2 illustrates one exemplary embodiment of the control dial, mounted on a controlled device. As indicated in phantom on FIG. 1, rim 240 may be formed with a generally cylindrical radial passage, into which may be inserted a metallic rod 120, which preferably protrudes at a point of the circumference of housing 23 which is perpendicular to the axis of rotation of hinge 13 and disk 12. Alternatively, housing 23 may simply be formed with a protruding nipple at this point. Either protrusion provides a lip underneath disk 12 in its flush position to detain disk 12 in the flush position until positive pressure is applied to disk portion 121. At each of the switch settings OFF, SET RATE, RUN, HOLD, VOLUME FED, and CLEAR VOLUME shown in FIG. 2, a click-stop is provided either as part of switch 100 or as part of the rotary control dial structure.

Those skilled in the art will appreciate that numerous variations are possible within the scope of the inventive concept, and that the scope of the invention is not restricted to the particular embodiments described, but rather is defined by the appended claims.

I claim:

1. A snag-free and tamper-resistant portable medical device adapted to be carried by a patient, and having a rotational control dial, comprising a case having an outer surface with an indentation formed therein;

a housing disposed at least partially within said indentation, said housing being shaped to define a recess therein;

means rotatably supporting said housing for rotation within said indentation;

rotary switch means secured to said housing and operatively coupled for actuation by rotation of said housing;

a generally disk-shaped handle with a rounded edge, pivotally mounted on said housing, said handle being pivotable between a first position generally flush with said outer surface of said case, in which tampering by actuation of said rotary switch means is difficult, and a second position protruding from said outer surface, permitting rotation of said housing by placing said handle in said second position and applying rotation force thereto, said rounded edge of said protruding, generally disk-shaped handle tending to slide smoothly against, rather than snag on, any portion of the patient coming into contact therewith;

wherein said indentation and said housing each have a generally hemi-spherical configuration, an inner surface of said housing having an approximately quarter-spherical portion of reduced diameter forming a stop for said handle in said first, flush position and a stop for said handle in said second, protruding position.

* * * * *